US011103922B2

(12) United States Patent
Gotoh et al.

(10) Patent No.: US 11,103,922 B2
(45) Date of Patent: Aug. 31, 2021

(54) FE—CO ALLOY POWDER AND METHOD FOR PRODUCING THE SAME, AND ANTENNA, INDUCTOR AND EMI FILTER

(71) Applicant: DOWA ELECTRONICS MATERIALS CO., LTD., Tokyo (JP)

(72) Inventors: Masahiro Gotoh, Tokyo (JP); Takayuki Yoshida, Tokyo (JP)

(73) Assignee: DOWA ELECTRONICS MATERIALS CO., LTD., Tokyo (JP)

( * ) Notice: Subject to any disclaimer, the term of this patent is extended or adjusted under 35 U.S.C. 154(b) by 711 days.

(21) Appl. No.: 15/129,032

(22) PCT Filed: Mar. 27, 2015

(86) PCT No.: PCT/JP2015/059622
§ 371 (c)(1),
(2) Date: Sep. 26, 2016

(87) PCT Pub. No.: WO2015/152048
PCT Pub. Date: Oct. 8, 2015

(65) Prior Publication Data

US 2018/0169752 A1 Jun. 21, 2018

(30) Foreign Application Priority Data

Mar. 31, 2014 (JP) ..... JP2014-072155

(51) Int. Cl.
*B22F 1/00* (2006.01)
*C22C 38/00* (2006.01)
(Continued)

(52) U.S. Cl.
CPC ..... *B22F 1/0018* (2013.01); *B22F 1/0088* (2013.01); *B22F 9/26* (2013.01);
(Continued)

(58) Field of Classification Search
CPC ..... B22F 1/0018; B22F 1/0088; B22F 9/26; B22F 2998/00; B22F 2304/054;
(Continued)

(56) References Cited

U.S. PATENT DOCUMENTS 4,789,591 A * 12/1988 Nakamura ..... G11B 5/70647 252/62.54
6,999,818 B2 * 2/2006 Stevenson ..... A61N 1/3754 607/36
(Continued)

FOREIGN PATENT DOCUMENTS

JP 2006190842 A * 7/2006
JP 2010-103427 5/2010
(Continued)

OTHER PUBLICATIONS

Konno et al., JP-2006190842-A, published Jul. 20, 2006. machine translation (Year: 2006).*

*Primary Examiner* — John A Hevey
(74) *Attorney, Agent, or Firm* — Clark & Brody LP

(57) ABSTRACT

A method for producing a Fe—Co alloy powder suitable for an antenna includes steps, wherein when introducing an oxidizing agent into an aqueous solution containing Fe ions and Co ions to generate crystal nuclei and cause precipitation and growth of a precursor having Fe and Co as components, Co in an amount corresponding to 40% or more of the total amount of Co used for the precipitation reaction is added to the aqueous solution at a time after the start of the crystal nuclei generation and before the end of the precipitation reaction to obtain the precursor. Then, a dried product of the precursor is reduced to obtain a Fe—Co alloy powder. This Fe—Co alloy powder has a mean particle size of 100 nm or less, a coercive force Hc of 52.0 to 78.0 kA/m, and a saturation magnetization ss of 160 $Am^2/kg$ or higher.

11 Claims, 1 Drawing Sheet

(51) Int. Cl.

| | |
|---|---|
| ***H01Q 7/08*** | (2006.01) |
| ***H01Q 9/04*** | (2006.01) |
| ***H01F 1/26*** | (2006.01) |
| ***C22C 38/10*** | (2006.01) |
| ***H01R 13/719*** | (2011.01) |
| ***H01F 1/24*** | (2006.01) |
| ***H01F 1/33*** | (2006.01) |
| ***B22F 9/26*** | (2006.01) |

(52) U.S. Cl.
CPC ..... *C22C 38/00* (2013.01); *H01F 1/24* (2013.01); *H01F 1/33* (2013.01); *H01Q 7/08* (2013.01); *H01Q 9/0407* (2013.01); *H01Q 9/0421* (2013.01); *B22F 2201/01* (2013.01); *B22F 2301/40* (2013.01); *B22F 2304/05* (2013.01); *B22F 2304/054* (2013.01); *B22F 2998/00* (2013.01); *C22C 38/10* (2013.01); *C22C 2202/02* (2013.01); *H01F 1/26* (2013.01); *H01R 13/719* (2013.01)

(58) Field of Classification Search
CPC ..... B22F 2301/40; B22F 2201/01; B22F 2304/05; H01Q 9/0407; H01Q 9/0421; H01Q 7/08; H01F 1/24; H01F 1/33; H01F 1/26; C22C 38/00; C22C 38/10; C22C 2202/02; H01R 13/719
See application file for complete search history.

(56) References Cited

U.S. PATENT DOCUMENTS

| | | | | |
|---|---|---|---|---|
| 2005/0202289 | A1* | 9/2005 | Ishikawa | G11B 5/70 428/847.4 |
| 2008/0055178 | A1* | 3/2008 | Kim | H01Q 1/38 343/787 |

FOREIGN PATENT DOCUMENTS

| | | | |
|---|---|---|---|
| JP | 2011-096923 | | 5/2011 |
| JP | 2012212807 | A * | 11/2012 |
| JP | 2013-236021 | | 11/2013 |

* cited by examiner

[Fig.1]
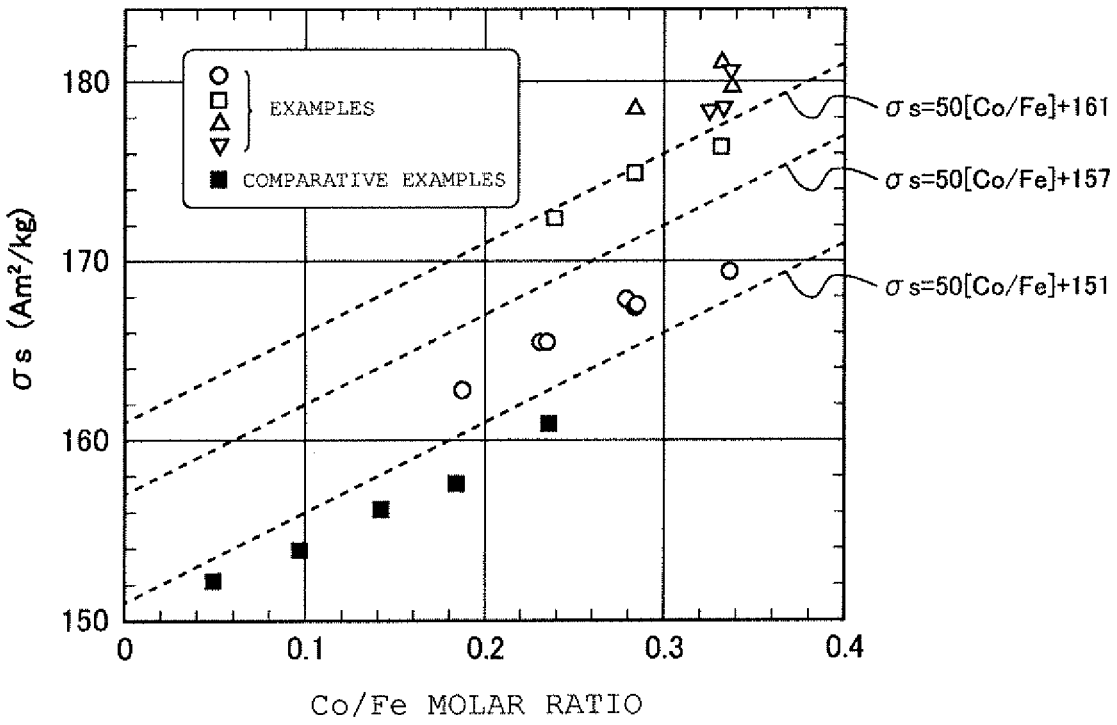
[Fig.2]
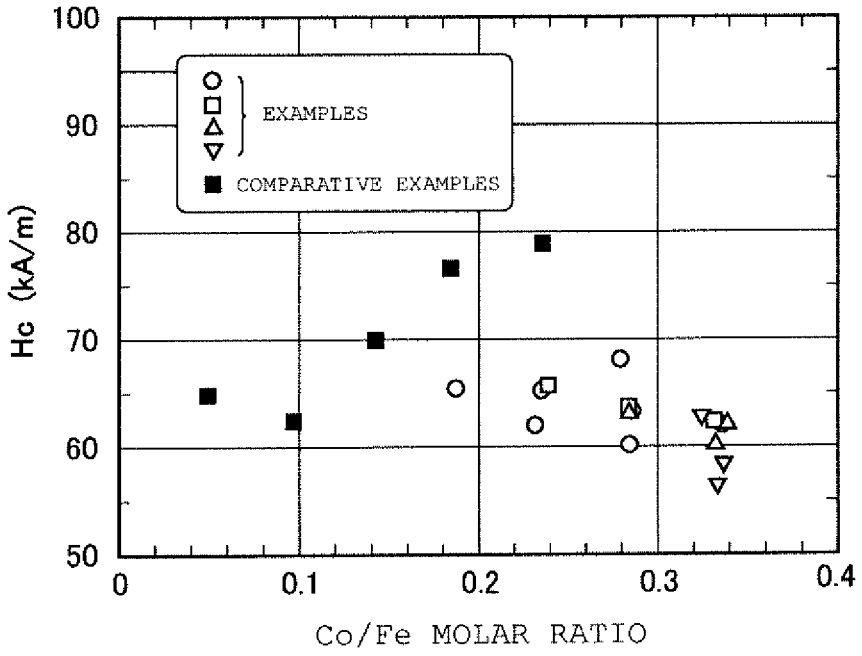

FE—CO ALLOY POWDER AND METHOD FOR PRODUCING THE SAME, AND ANTENNA, INDUCTOR AND EMI FILTER

TECHNICAL FIELD

The present invention relates to a metal magnetic powder which is advantageous in enhancement of the relative permeability in a band of from several hundred megahertz to several gigahertz, and to a method for producing the same.

BACKGROUND ART

In recent years, various portable terminals and other electronic devices using radio waves of from several hundred megahertz to several gigahertz as communication means have been popular. As a small antenna suitable for these devices, there is known a planar antenna comprising a conductive plate and a radiation plate disposed in parallel to the conductive plate. In order to further reduce the size of such an antenna, it is advantageous to place a magnetic body having a high magnetic permeability between the conductive plate and the radiation plate. However, since a conventional magnetic body has shown a large loss in a frequency band higher than several hundred megahertz, a type of planar antenna in which a magnetic body is used has not been so popular yet. For example, PTLs 1 and 2 disclose a metal magnetic powder having an increased real part μ' of the complex relative permeability, but with respect to the loss tangent tan δ (μ) of the complex relative permeability which is a measure of the magnetic loss, a sufficient effect of improving the level has not always been obtained.

PTL 3 discloses a technique of lowering the loss tangent tan δ (μ) by making the axial ratio (=major axis/minor axis) of a particle of a Fe—Co alloy powder relatively large to increase the magnetic anisotropy.

CITATION LIST

Patent Literature

PTL 1: JP-A-2011-96923
PTL 2: JP-A-2010-103427
PTL 3: JP-A-2013-236021

SUMMARY OF INVENTION

Technical Problem

A magnetic body having a large μ' and a small loss tangent tan δ (μ)=μ"/μ' is advantageous for reducing the size of an antenna for high frequency. Here, μ' is the real part of the complex relative permeability, μ" is the imaginary part of the complex relative permeability. For increasing μ', it is effective to increase the saturation magnetization σs of the metal magnetic powder. Generally in Fe—Co alloy powder, there is a tendency of increasing σs with increase of the Co content. However, when a Fe—Co alloy powder having a large Co content is produced by means of a conventionally common production method, there is a problem in that μ' is not sufficiently increased in spite of an increased σs.

An object of the present invention is to provide a Fe—Co alloy powder suitable for an antenna, which has a high saturation magnetization σs and a controlled coercive force Hc, and provides an extremely large μ' and a sufficiently small tan δ (μ), and to provide an antenna using the same.

Solution to Problem

In order to achieve the above object, in the present invention, a Fe—Co alloy powder having a mean particle size of 100 nm or less, and having the coercive force Hc of 52.0 to 78.0 kA/m, and a saturation magnetization σs ($Am^2/kg$) of 160 $Am^2/kg$ or higher is provided. The σs satisfies, for example, the following formula (1), in a relationship with the Co/Fe molar ratio:

$$\sigma s \geq 50[Co/Fe]+151 \quad (1)$$

wherein, [Co/Fe] means the molar ratio of Co and Fe in the chemical composition of the powder.

The Co/Fe molar ratio of the Fe—Co alloy powder is preferably 0.15 to 0.50. The mean axial ratio (=mean major axis/mean minor axis) of the particles constituting the powder is desirably more than 1.40 and less than 1.70.

The Fe—Co alloy powder preferably has such a property that, when the powder is mixed with an epoxy resin in a mass ratio of 90:10 to produce a molded body and the molded body is subjected to a magnetic measurement, the real part μ' of the complex relative permeability is 2.50 or more and the loss tangent tan δ (μ) of the complex relative permeability is less than 0.05, at 1 GHz. In addition, the powder preferably has such a property that the real part μ' of the complex relative permeability is 2.80 or more and the loss tangent tan δ (μ) of the complex relative permeability is less than 0.12, at 2 GHz, and the tan δ (μ) can be controlled to less than 0.10. Furthermore, the powder preferably has such a property that the real part μ' of the complex relative permeability is 3.00 or more and the loss tangent tan δ (μ) of the complex relative permeability is less than 0.30, at 3 GHz. As for the electric resistance of the powder, according to a double ring electrode method in accordance with JIS K6911, when 1.0 g of the metal powder is interposed between electrodes and a measurement is performed at an applied voltage of 10 V while exerting a vertical load of 25 MPa (8 kN), the volume resistivity is preferably $1.0\times10^8$ Ω·cm or more.

As a method for producing the Fe—Co alloy powder, provided is a method comprising the steps of:

introducing an oxidizing agent into an aqueous solution containing Fe ions and Co ions to generate crystal nuclei and cause precipitation and growth of a precursor having Fe and Co as components, wherein Co in an amount corresponding to 40% or more of the total amount of Co used for the precipitation reaction is added to the aqueous solution at a time after the start of the crystal nuclei generation and before the end of the precipitation reaction to obtain the precursor (a precursor forming step), heating a dried product of the precursor to 250 to 650° C. in a reducing gas atmosphere to obtain a metal powder having a Fe—Co alloy phase (a reduction step), forming an oxide protection layer on a surface layer portion of a particle of the metal powder after reduction (a stabilization step), and optionally further performing a heating process at 250 to 650° C. in a reducing gas atmosphere and a subsequent process which is the same as the stabilization step one or more times (a reduction/stabilization repeating step).

In the precursor forming step, the total amount of Co used for the precipitation reaction is preferably within the range of 0.15 to 0.50 in terms of the Co/Fe molar ratio. As necessary, the crystal nuclei can be generated in a state where a rare earth element (Y is also considered as a rare earth element) is present in the aqueous solution. By changing the amount of the rare earth element added before the formation of the crystal nuclei, the axial ratio of particles constituting the obtained precursor and the finally obtained metal magnetic powder can be changed. In addition, the precipitation and growth can be allowed to proceed in a state where one or more of a rare earth element (Y is also considered as a rare earth element), Al, Si, and Mg are present in the aqueous solution.

In the present invention, an antenna formed by using the Fe—Co alloy powder is provided. In particular, a suitable target is an antenna for receiving, transmitting, or receiving and transmitting a radio wave having a frequency of 430 MHz or more, which comprises as a constitution member a molded body in which the Fe—Co alloy powder and a resin composition are mixed. In addition, an inductor and an EMI filter formed by using the Fe—Co alloy powder are provided.

Advantageous Effects of Invention

According to the present invention, in the Fe—Co alloy powder, the saturation magnetization σs when compared in the same Co content has become able to be significantly enhanced than before. The increase in the coercive force Hc with the increase of the Co content is also suppressed. The enhancement of σs and the suppression of Hc are highly advantageous for enhancing the real part μ' of the complex relative permeability which is important as a high frequency characteristic. According to the present invention, it is possible to appropriately control the axial ratio of the powder particles, and increase in the magnetic loss tan δ (μ) is also suppressed. Accordingly, the present invention contributes to the size reduction and the performance enhancement of an antenna for high frequency and the like. The present invention contributes to the size reduction and the performance enhancement of, not only an antenna for high frequency, but also an inductor, and furthermore an EMI filter.

BRIEF DESCRIPTION OF DRAWINGS

FIG. 1 is a graph showing a relationship between the total Co/Fe molar ratio and the saturation magnetization σs.

FIG. 2 is a graph showing a relationship between the total Co/Fe molar ratio and the coercive force Hc.

DESCRIPTION OF INVENTION

As described above, when particles having a high Co content are produced by a conventional production method of Fe—Co alloy powder, μ' can not be sufficiently enhanced although the saturation magnetization σs is increased. As a result of a study of the reason in detail, it has been found that when particles having a high Co content are produced by a conventional production method, the axial ratio of the particle is large and the resonance frequency is shifted to the high frequency side due to increase of the magnetic anisotropy, whereby μ' can not be sufficiently enhanced. The magnetic anisotropy is closely related to the coercive force Hc, and Hc increases as the magnetic anisotropy increases. Therefore, for sufficiently enhancing μ', it is important to enhance σs as a magnetic characteristic required for an magnetic body and to control the coercive force Hc so as not to be larger than necessary. On the other hand, when the coercive force Hc is too small, tan δ (μ) is then larger, and the loss in use for an antenna is increased. From the viewpoint of the tan δ (μ), it is found to be important to control the coercive force Hc so as not to be excessively small.

As a result of the study in detail, the present inventors have found that, in the case where a precursor is precipitated and grown in an aqueous solution and the precursor is subjected to reduction firing to obtain a Fe—Co alloy magnetic powder, when a technique is used in which a part of Co used for the precipitation reaction is additionally added to the solution in the middle phase in the course of precipitation and growth of the precursor, the saturation magnetization σs can be significantly enhanced without excessive increase of the coercive force Hc. As a result, it is possible to significantly enhance μ' while keeping tan δ (μ) low. The present invention has been completed based on the findings.

<<Metal Magnetic Powder>>

[Chemical Composition]

A Co content in a Fe—Co alloy powder is herein represented by a molar ratio of Co and Fe. The molar ratio is referred to as "Co/Fe molar ratio". In general, the saturation magnetization σs tends to increase with increase of the Co/Fe molar ratio. According to the present invention, when compared in the same Co/Fe molar ratio, a higher σs than that of a conventionally common Fe—Co alloy powder is obtained. The effect of improving σs is obtained in a wide range of the Co content. For example, a Fe—Co alloy powder having a Co/Fe molar ratio of 0.05 to 0.80 can be targeted. When considering use in which a high σs is required, such as use for an antenna for high frequency, the Co/Fe molar ratio is preferably 0.15 or more, more preferably 0.20 or more. Although a higher Co content is desirable in terms of obtaining a higher σs, an excessive Co content is a factor of increasing cost. Accordingly, the Co/Fe molar ratio is desirably 0.70 or less, more preferably 0.60 or less, further preferably 0.50 or less. According to the present invention, even when the Co/Fe molar ratio is in the range of 0.40 or less, or further 0.35 or less, a high σs can be achieved.

As a metal element other than Fe and Co, one or more of a rare earth element (Y is also considered as a rare earth element), Al, Si, and Mg can be contained. The rare earth element, Si, Al, and Mg have been added as needed in a conventionally known production process of metal magnetic powder, and the inclusion of these elements is permitted also in the present invention. A typical example of the rare earth element to be added to the metal magnetic powder is Y. In the molar ratio relative to the total amount of Fe and Co, a rare earth element/(Fe+Co) molar ratio can be 0 to 0.20, more preferably 0.001 to 0.05. The Si/(Fe+Co) molar ratio can be 0 to 0.30, more preferably 0.01 to 0.15. The Al/(Fe+Co) molar ratio can be 0 to 0.20, more preferably 0.01 to 0.15. The Mg/(Fe+Co) molar ratio can be 0 to 0.20.

[Particle Size]

The particle size of the particles constituting the metal magnetic powder can be determined through observation with a transmission electron microscope (TEM). A diameter of the minimum circle surrounding a particle on a TEM image is defined as the diameter (major axis) of the particle. The diameter means a diameter including an oxide protection layer covering the circumference of a metal core. Diameters are measured for 300 randomly selected particles and the average thereof may be defined as the mean particle size of the metal magnetic powder. In the present invention, particles having a mean particle size of 100 nm or less are targeted. On the other hand, super fine powder having a mean particle size less than 10 nm leads to increase of the production cost and deterioration of the handling property, and therefore the mean particle size may be generally 10 nm or more.

[Axial Ratio]

For a particle on a TEM image, the largest length measured in a direction perpendicular to the "major axis" mentioned above is referred to as the "minor axis", and the ratio of the major axis/the minor axis is referred to as the "axial ratio" of the particle. The "mean axial ratio" which is an average axial ratio in powder can be determined as follows. Through TEM observation, the "major axis" and the "minor axis" are measured for 300 randomly selected particles, and the average of the major axes and the average of the minor axes of the all particles to be measured are respectively defined as the "mean major axis" and the "mean minor axis" and the ratio of the mean major axis/the mean minor axis is defined as the "mean axial ratio". The Fe—Co alloy powder according to the present invention desirably has a mean axial ratio within the range of more than 1.40 and less than 1.70. When the axial ratio is 1.40 or less, the imaginary part μ" of the complex relative permeability is increased due to a decreased shape magnetic anisotropy, which is disadvantageous in a use in which a decrease of the loss tangent δ (μ) is important. On the other hand, when the mean axial ratio exceeds 1.70, the effect of enhancing the saturation magnetization σs is likely to be reduced, which deteriorates the advantage in a use in which an enhancement of the real part μ' of the complex relative permeability is important.

[Powder Characteristics]

The coercive force Hc is desirably 52.0 to 78.0 kA/m. When Hc is too low, tan δ (μ) may be large in the characteristic at a frequency of 430 MHz or higher and the loss in use for an antenna is increased. On the other hand, an excessively high Hc may be a factor of lowering the real part μ' of the complex relative permeability in the high frequency characteristics. In this case, the effect of enhancing μ' by increase of σs is cancelled, which is not preferable. Hc is preferably less than 70.0 kA/m. By adopting the Co addition technique described later, the coercive force can be controlled in the above range.

In the Fe—Co magnetic powder according to the present invention, the saturation magnetization σs ($Am^2/kg$) satisfies the following formula (1) in a relationship with the Co/Fe molar ratio.

$$\sigma s \geq 50[Co/Fe]+151 \quad (1)$$

Here, [Co/Fe] means the molar ratio of Co and Fe in the chemical composition of the powder.

The metal magnetic powder satisfying the formula (1) shows, as compared to a conventionally common Fe—Co alloy powder, a higher σs in a smaller Co addition amount, whereby a use amount of Co which is expensive than Fe can be saved, and thus such a metal magnetic powder is superior in the cost performance. Furthermore, a Fe—Co powder which satisfies the formula (1) and has a coercive force Hc adjusted in the above range has conventionally not been able to be obtained, and is advantageous in the high frequency characteristics, particularly in enhancement of μ'. In a use for high frequency such as a planar antenna, σs is preferably adjusted to 160 $Am^2/kg$ or higher. When σs is lower than 160 $Am^2/kg$, μ' is small and the effect of reducing the size of an antenna using the powder is small. Incidentally, σs may generally be in the range of 200 $Am^2/kg$ or lower. By adopting the Co addition technique described later, σs satisfying the formula (1) can be realized.

In place of the above formula (1), a powder satisfying the following formula (2) or the following formula (3) can be obtained.

$$\sigma s \geq 50[Co/Fe]+157 \quad (2)$$

$$\sigma s \geq 50[Co/Fe]+161 \quad (3)$$

As other powder characteristics, it is preferred that the BET specific surface area is within the range of 30 to 70 $m^2/g$, the TAP density is within the range of 0.8 to 1.5 $g/cm^3$, the squareness ratio SQ is within the range of 0.3 to 0.6, and that SFD is in the range of 3.5 or less. As for the weather resistance, a test of keeping a metal magnetic powder in an air atmosphere of a temperature of 60° C. and a relative humidity of 90% for 1 week is performed, and Δσs which represents a variation ratio in σs between before and after the test is preferably 15% or less. Here, Δσs (%) is calculated by "((σs before test−σs after test)/σs before test)×100". As for the insulation, according to a double ring electrode method in accordance with JIS K6911, when 1.0 g of the metal magnetic powder is interposed between electrodes and a measurement is performed at an applied voltage of 10 V while exerting a vertical load of 25 MPa (8 kN), the volume resistivity is preferably $1.0\times10^8$ Ω·cm or more.

[Magnetic Permeability and Permittivity]

The magnetic permeability and the permittivity which are exhibited by the Fe—Co alloy powder can be evaluated using a sample of a toroidal shape produced by mixing a Fe—Co alloy powder with a resin in a mass ratio of 90:10. As the resin to be used here, a known thermosetting resin including an epoxy resin and a known thermoplastic resin can be used. The powder preferably has such a property that, when formed into such a molded body, at 1 GHz, the real part μ' of the complex relative permeability is preferably 2.50 or more and the loss tangent tan δ (μ) of the complex relative permeability is less than 0.05, more preferably has such a property that μ' is 2.70 or more and tan δ (μ) is less than 0.03. A lower tan δ (μ) is more preferred, but in general, tan δ (μ) may be adjusted to the range of 0.005 or more.

The Fe—Co alloy powder according to the present invention has excellent magnetic characteristics also in a frequency range higher than 1 GHz. As an example of high frequency characteristics at 2 GHz in the above molded body, a Fe—Co alloy powder having such a property that μ' is 2.80 or more and tan δ (μ) is less than 0.12 or less than 0.10 is a suitable target. Similarly, as an example of high frequency characteristics at 3 GHz, one having such a property that μ' is 3.00 or more and tan δ (μ) is 0.300 or less, more preferably 0.250 or less is a suitable target.

In particular, according to the present invention, it is possible to specifically produce a Fe—Co alloy powder which can exhibit such very excellent high frequency characteristics that, at 1 GHz, μ' is 3.50 or more and tan δ (μ) is less than 0.025, at 2 GHz, μ' is 3.80 or more and tan δ (μ) is less than 0.12, and at 3 GHz, μ' is 4.00 or more and tan δ (μ) is less than 0.30.

<<Production Method>>

The Fe—Co magnetic powder can be produced through the following steps.

[Precursor Forming Step]

An oxidizing agent is introduced into an aqueous solution in which Fe ions and Co ions dissolve to generate crystal nuclei and a precursor containing Fe and Co as components is precipitated and grown. However, Co in an amount corresponding to 40% or more of the amount of the total amount of Co used for the precipitation reaction is added to the aqueous solution at the time after the start of the crystal nuclei generation and before the end of the precipitation reaction. For example, in the case where the amount of the total Co used for the precipitation reaction is 0.30 in terms of the Co/Fe molar ratio, Co in an amount corresponding to 40% or more thereof, that is, 0.30×(40/100)=0.12 or more in terms of the Co/Fe molar ratio is added at the time after the start of the crystal nuclei generation and before the end of the precipitation reaction. Herein under, an aqueous solution before the start of the crystal nuclei generation (that is, before the start of the oxidizing agent introduction) is referred to as "reaction original solution", and the time before the start of the crystal nuclei generation is referred to as "initial phase". The time after the start of the crystal nuclei generation (that is, after the start of the oxidizing agent introduction) and before the end of the precipitation reaction is referred to as "middle phase", and the operation of adding a water soluble substance into a liquid in the middle phase to dissolve the substance therein is referred to as "middle addition".

At least Fe ions have to be present in the reaction original solution. As the aqueous solution in which Fe ions are present, suitable is an aqueous solution containing divalent Fe ions obtained by neutralizing a water soluble iron compound (iron sulfate, iron nitrate, iron chloride, etc) with an aqueous solution of alkali hydroxide (NaOH, KOH, etc.) or an aqueous solution of an alkali carbonate (sodium carbonate, ammonium carbonate, etc.). In the reaction original solution, a part of Co among the total Co used for the precipitation reaction has desirably been already dissolved. As the Co source, a water soluble cobalt compound (cobalt sulfate, cobalt nitrate, cobalt chloride, etc.) can be used. As an oxidizing agent, air or other oxygen-containing gas, hydrogen peroxide, etc. can be used. An oxygen-containing gas was passed through the reaction original solution or an oxidizing agent substance such as hydrogen peroxide was added to the reaction original solution, thereby generating crystal nuclei of the precursor. After that, the oxidizing agent is further continuously introduced to precipitate a Fe compound and optionally further a Co compound on the surface of the crystal nuclei and allow the precursor particles to grow. The precursor is considered to mainly contain crystal of iron oxyhydroxide or crystal having a structure of iron oxyhydroxide with a part of the Fe sites thereof substituted with Co.

Conventionally, the entire amount of Co is usually dissolved in advance in the initial phase of the reaction original solution. However, in the conventional Co addition method, with increase of the Co content, the saturation magnetization σs is increased and the coercive force Hc is also increased. As a reason of that, it is considered that precipitation tends to occur in a direction of the major axis due to the Co addition and thus the effect of the shape magnetic anisotropy due to increase of the axial ratio becomes larger. An increase of the coercive force Hc is a factor of lowering the real part μ' of the complex relative permeability. In order to improve the high frequency characteristics, development of a new technique in which the saturation magnetization σs can be increased while suppressing increase of the coercive force Hc has been demanded. As a result of a study in detail, the present inventors have found that by adding a part of Co in the middle of the course, it is possible to suppress increase of the coercive force Hc and to significantly enhance the saturation magnetization σs.

By allocating a part of the total Co content to a middle addition, the Co content in the initial phase can be lowered. This makes it possible to cause the precipitation and growth of the precursor in a state where the amount of the dissolved Co is small, thereby suppressing increase of the axial ratio. It has been found that even when a large amount of Co is added after the precursor particles have already been grown to an extent, the phenomenon that the precipitation preferentially proceeds only in a direction of the major axis is mitigated unlike to a growth starting from a phase of crystal nuclei. Thus, for the same total Co content, a precursor particle having a smaller axial ratio can be obtained. In this particle, the Co concentration is considered to be higher in the circumference portion than at the central portion, but it is considered that the variation in concentration of Fe and Co is equalized by atomic diffusion during reduction firing. The effective amount of Co to be added in the middle is an amount corresponding to 40% or more of the total amount of Co used for the precipitation reaction.

The Co middle addition can be conducted according to a method of direct charge of the water soluble cobalt compound as mentioned above, or a method of charging a solution containing Co previously dissolved. Addition at one time, divided addition, or continuous addition may be appropriately selected. It is preferred that Co in an amount corresponding to 40% or more of the total Co amount is added in the middle after the time when 10% of the total Fe amount used for the precipitation reaction is oxidized (that is, consumed in the precipitation reaction). It is more preferred that Co in an amount corresponding to 40% or more of the total Co amount is added in the middle after the time when 20% of the total Fe amount used for the precipitation reaction is oxidized.

As required, the precipitation and growth of the precursor can be allowed to proceed in a state where one or more of a rare earth element (Y is also considered as a rare earth element), Al, Si, and Mg are present in the aqueous solution. The addition time of such an element may be any of in the initial phase, in a middle phase, or in the initial phase and the middle phase. As a supply source of the element, a water soluble compound of each element may be used. Examples of the water soluble rare earth element compound include, in the case of an yttrium compound, yttrium sulfate, yttrium nitrate, and yttrium chloride. Examples of the water soluble aluminum compound include aluminum sulfate, aluminum chloride, aluminum nitrate, sodium aluminate, and potassium aluminate. Examples of the water soluble silicon compound include sodium silicate, sodium orthosilicate, and potassium silicate. Examples of the water soluble magnesium compound include magnesium sulfate, magnesium chloride, and magnesium nitrate. With respect to the content in the case where such an additional element is contained, the rare earth element/(Fe+Co) molar ratio is preferably in the range of 0.20 or less, and may be controlled within the range of 0.001 to 0.05. The Al/(Fe+Co) molar ratio is preferably in the range of 0.20 or less, and may be controlled within the range of 0.01 to 0.15. The Si/(Fe+Co) molar ratio is preferably in the range of 0.30 or less, and may be controlled within the range of 0.01 to 0.15. The Mg/(Fe+Co) molar ratio is preferably in the range of 0.20 or less, and may be controlled within the range of 0.01 to 0.15.

[Reduction Step]

A dried product of the precursor obtained by the above method is heated in a reducing gas atmosphere, thereby obtaining a metal powder having a Fe—Co alloy phase. As a typical reducing gas, hydrogen gas is mentioned. The heating temperature may be within the range of 250 to 650° C., more preferably 500 to 650° C. The heating time is adjusted within the range of 10 to 120 min.

[Stabilization Step]

The metal powder obtained after the completion of the reduction step is possibly rapidly oxidized when exposed to the air as it is. The stabilization step is a step for forming an oxide protection layer on the surface of the particle while avoiding the rapid oxidation. The atmosphere to which the metal powder after the reduction is exposed is changed to an inert gas atmosphere, and while increasing the oxygen concentration in the atmosphere, an oxidation reaction of the surface layer portion of the metal powder particle is allowed to proceed at 20 to 300° C., more preferably at 50 to 300° C. In the case where the stabilization step is performed in the same furnace as in the reduction step, after the end of the reduction step, the reducing gas in the furnace is substituted with an inert gas, and while introducing an oxygen-containing gas into the inert gas atmosphere in the above temperature range, the oxidation reaction of the particle surface layer may be allowed to proceed. The stabilization step may be performed after the metal powder is transferred to another heat treating apparatus. Alternatively, the stabilization step may be continuously performed while transferring the metal powder after the reduction step with a conveyer or the like. In both cases, it is important that the metal powder after the reduction step is shifted to the stabilization step without being exposed to the air. As the inert gas, one or more gas components selected from a rare gas and nitrogen gas may be applied. As the oxygen-containing gas, pure oxygen gas and air can be used. Water vapor can be introduced with the oxygen-containing gas. Water vapor has an effect of densifying oxidized film. The oxygen concentration during the metal magnetic powder is kept at 30 to 300° C., preferably at 50 to 300° C., is finally made to 0.1 to 21% by volume. The introduction of the oxygen-containing gas may be made continuously or intermittently. In the initial phase of the stabilization step, the state where the oxygen concentration is 1.0% by volume or less is preferably kept for a time period of 5.0 min or more.

[Reduction/Stabilization Repeating Step]

After the stabilization step, a heating process at 250 to 650° C. in a reducing gas atmosphere and a subsequent process which is the same as the stabilization step can be performed one or more times. This can increase the effect of enhancing the saturation magnetization σs due to the Co addition.

<<Antenna>>

The Fe—Co alloy powder according to the present invention can be used as a material constituting an antenna. For example, a planar antenna comprising a conductive plate and a radiation plate disposed in parallel to the conductive plate is exemplified. A configuration of a planar antenna is disclosed in, for example, FIG. 1 of PTL 3. The Fe—Co alloy powder according to the present invention is highly useful as a material of a magnetic body for an antenna that transmits, receives, or transmits and receives radio waves of 430 MHz or higher. In particular, the Fe—Co alloy powder is effectively applied to an antenna used in a frequency band of 700 MHz to 6 GHz.

The Fe—Co alloy powder according to the present invention is mixed with a resin composition to form a molded body, which is then used as a magnetic body of the antenna as described above. As the resin, a known thermosetting resin or thermoplastic resin may be applied. The thermosetting resin can be selected from, for example, a phenol resin, an epoxy resin, an unsaturated polyester resin, an isocyanate compound, a melamine resin, a urea resin, and a silicone resin. As the epoxy resin, any one of a monoepoxy compound and a polyepoxy compound, or a mixture thereof can be used. As a monoepoxy compound and polyepoxy compound, various compounds listed in PTL 3 may be appropriately selected and used. The thermoplastic resin may be selected from a polyvinyl chloride resin, an ABS resin, a polypropylene resin, a polyethylene resin, a polystyrene resin, an acrylonitrile styrene resin, an acryl resin, a polyethylene terephthalate resin, a polyphenylene ether resin, a polysulfone resin, a polyarylate resin, a polyetherimide resin, a polyether ether ketone resin, a polyethersulfone resin, a polyamide resin, a polyamide imide resin, a polycarbonate resin, a polyacetal resin, a polybutylene terephthalate resin, a polyether ether ketone resin, a polyethersulfone resin, a liquid crystal polymer (LCP), a fluoride resin, an urethane resin, and the like.

The ratio of mixing of the Fe—Co alloy powder and the resin is, in terms of the mass ratio of the metal magnetic powder/resin, preferably 30/70 or more and 99/1 or less, more preferably 50/50 or more and 95/5 or less, further preferably 70/30 or more and 90/10 or less. When the amount of the resin is too small, a molded body can not be formed, and when the amount is too large, desired magnetic characteristics can not be obtained.

EXAMPLES

Example 1

[Production of Reaction Original Solution]

A 1 mol/L aqueous ferric sulfate solution and a 1 mol/L aqueous cobalt sulfate solution were mixed so as to provide a molar ratio of Fe:Co of 100:10 to make about 800 mL of a solution, and a 0.2 mol/L aqueous yttrium sulfate solution was added thereto so as to provide a Y/(Fe+Co) molar ratio of 0.026, thereby providing about 1 L of a Fe, Co and Y-containing solution. In a 5000 mL beaker, 2600 mL of pure water and 350 mL of an ammonium carbonate solution were added, and the mixture was stirred while maintaining the temperature at 40° C. with a temperature controller, thereby obtaining an aqueous ammonium carbonate solution. Incidentally, the concentration of the ammonium carbonate solution was adjusted so as to provide 3 equivalents of carbonate ion $CO_3^{2-}$ relative to $Fe^{2+}$ in the Fe, Co and Y-containing solution. The Fe, Co and Y-containing solution was added to the aqueous ammonium carbonate solution, whereby a reaction original solution was obtained. In this example, the charging Co/Fe molar ratio in the initial phase (reaction original solution) is 0.10.

[Formation of Precursor]

To the reaction original solution, 5 mL of a 3 mol/L aqueous $H_2O_2$ solution was added to generate crystal nuclei of iron oxyhydroxide. Then, the temperature of the liquid was raised to 60° C., and air was blown into the liquid at a velocity of 163 mL/min until 40% of the total $Fe^{2+}$ present in the reaction original solution was oxidized. The amount of air blow required in this time had been grasped in advance by a previous experiment. Then, a 1 mol/L aqueous cobalt sulfate solution containing Co in an amount to provide a Co/Fe molar ratio of 0.10 (=10% by mole) relative to the total amount of Fe in the reaction original solution was added in the middle. After the middle addition of Co, a 0.3 mol/L aqueous aluminum sulfate solution was added in an amount to provide an Al/(Fe+Co) molar ratio of 0.055 relative to the total amount of Fe and Co (including Co added in the middle), and air was blown at a velocity of 163 mL/min until the oxidation was completed (that is, the reaction to form the precursor was completed). The thus-obtained precursor-containing slurry was filtered, washed with water, and then dried in air at 110° C., whereby a dried product (powder) of the precursor was obtained. In this example, the charging Co/Fe molar ratio in the middle addition is 0.10, and the charging Co/Fe molar ratio of the entire addition is 0.20. The charging addition amounts of Co are shown in Table 1.

[Reduction Treatment]

The dried product of the precursor was placed in a breathable bucket, which was then put in a feed-through type reduction furnace, and hydrogen gas was fed through the furnace and the temperature was kept at 630° C. for 40 min to apply a reduction treatment.

[Stabilization Treatment]

After the reduction treatment, the atmospheric gas in the furnace was converted from hydrogen to nitrogen, and while feeding nitrogen gas, the temperature in the furnace was lowered to 80° C. at a temperature decrease rate of 20° C./min. Then, gas in which nitrogen gas and air were mixed so as to provide the ratio by volume of nitrogen gas/air of 125/1 (oxygen concentration: about 0.17% by volume) was introduced as an initial gas for conducting the stabilization treatment into the furnace to start an oxidation reaction on the surface layer portion of particles of the metal powder, and then while gradually increasing the mixing ratio of air, the mixed gas, which finally had a ratio by volume of nitrogen gas/air of 25/1 (oxygen concentration: about 0.80% by volume), was continuously introduced into the furnace, whereby an oxide protection layer was formed on the surface layer portion of the particles. In the stabilization process, the temperature was kept at 80° C., and the flow rate of the gas introduction was kept substantially constant.

By the above steps, a test powder having a Fe—Co alloy phase as a magnetic phase was obtained.

[Composition Analysis]

The composition analysis of the test powder was performed by an ICP atomic emission analyzer. The results are shown in Table 1.

[Mean Particle Size, Mean Axial Ratio]

For the test powder, according to the above method by a TEM observation, the mean particle size and the mean axial ratio were measured. The results are shown in Table 1.

[Volume Resistivity]

The volume resistivity of the test powder was determined by a method in which 1.0 g of the test powder is interposed between electrodes and a measurement is performed at an applied voltage of 10 V while exerting a vertical load of 13 to 64 MPa (4 to 20 kN), according to a double ring electrode method in accordance with the JIS K6911. In the measurement, a powder resistivity measuring unit (MCP-PD51) manufactured by Mitsubishi Chemical Analytech, a high resistance resistivity meter, Hiresta UP (MCP-HT450) manufactured by the same company, and a high resistance powder measuring system software manufactured by the same company were used. The results are shown in Table 2.

[BET Specific Surface Area]

The BET specific surface area was determined by the BET one point method using 4-sorb US manufactured by Yuasa Ionics. The results are shown in Table 2.

[Tap Density]

The TAP density was measured by putting the test powder in a glass sample cell (5 mm diameter×40 mm height) and applying 200 tappings thereto at a tapping height of 10 cm. The results are shown in Table 2.

[Magnetic Characteristics and Weather Resistance of Powder]

As magnetic characteristics (bulk characteristics) of the test powder, the coercive force Hc (kA/m), the saturation magnetization σs ($Am^2/kg$), and the squareness ratio SQ were measured using a VSM apparatus (Toei Industry; VSM-7P) at an external magnetic field of 795.8 kA/m (10 kOe). As for the weather resistance, a test in which the metal magnetic powder was kept in an air environment of a temperature of 60° C. and a relative humidity of 90% for 1 week was conducted, and the weather resistance was evaluated by a variation ratio Δσs in σs between before and after the test. The Δσs is calculated by ((σs before test−σs after test)/σs before test)×100. The results are shown in Table 3.

In Table 3, the value of the right side of the aforementioned formula (1), and the difference between the σs ($Am^2/kg$) and the value of the right side of the formula (1) are also shown. When the difference between σs and the value of the right side of the formula (1) is 0 or a positive value, the formula (1) is satisfied.

[Measurement of Magnetic Permeability and Permittivity]

The test powder and an epoxy resin (TISC CO., LTD; one pack epoxy resin B-1106) were weighed in a mass ratio of 90:10, and kneaded using a vacuum stirring degassing mixer (EME; V-mini 300), thereby producing a paste in which the test powder was dispersed in the epoxy resin. The paste was dried on a hot plate at 60° C. for 2 h to give a composite of the metal powder and the resin, which was then crushed to a powder form, thereby producing a composite powder. The composite powder (0.2 g) was placed in a container of a doughnut shape and a load of 9800 N (1 ton) was applied with a hand pressor, whereby a molded body of a toroidal shape of an outer diameter of 7 mm and an inner diameter of 3 mm was obtained. For the molded body, using a network analyzer (Agilent Technology; E5071C) and a coaxial type S parameter method sample holder kit (Kanto Electronic Application and Development Inc.; CSH2-APC7, sample size: φ7.0 mm−φ3.04 mm×5 mm), at 0.1 to 4.5 GHz, the real part μ' and the imaginary part μ" of the complex relative permeability and the real part ε' and the imaginary part ε" of the complex relative permittivity were measured, to determine the loss tangent tan δ (μ)=μ"/μ' of the complex relative permeability and the loss tangent tan δ ((ε)=ε"/ε' of the complex relative permittivity. In Table 4, the results at 1 GHz, 2 GHz, and 3 GHz are shown.

Examples 2 and 3

Experiments were made under the same conditions as in Example 1 except that the charging Co/Fe molar ratios in the middle addition were respectively increased to 0.15 (Example 2) and 0.20 (Example 3). The production conditions and the results are shown in Table 1 to Table 4 as in Example 1 (the same is applied in the following examples).

Example 4

Experiment was made under the same conditions as in Example 2 except that when the precursor was grown, the velocity of the air blow after the Co middle addition was decreased to 81.5 mL/min.

Example 5

Experiment was made under the same conditions as in Example 3 except that when the precursor was grown, the velocity of the air blow after the Co middle addition was decreased to 40.8 mL/min.

Example 6

Experiment was made under the same conditions as in Example 5 except that the charging Co/Fe molar ratio in the middle addition was increased to 0.25.

Example 7

Experiment was made under the same conditions as in Example 5 except that the charging Co/Fe molar ratio in the initial phase was increased to 0.15 and the charging Co/Fe molar ratio in the middle addition was decreased to 0.15.

Example 8

Experiment was made under the same conditions as in Example 4 except that after the stabilization process, the reduction process and the stabilization process were performed one more time again in the same furnace. In this case, the conditions of the second reduction process and stabilization process were the same as the conditions of the first reduction process and stabilization process (the same is applied in Examples 9 and 10 below).

Example 9

Experiment was made under the same conditions as in Example 5 except that after the stabilization process, the reduction process and the stabilization process were performed one more time again in the same furnace.

Example 10

Experiment was made under the same conditions as in Example 6 except that after the stabilization process, the reduction process and the stabilization process were performed one more time again in the same furnace.

Example 11

Experiment was made under the same conditions as in Example 9 except that the temperature in the stabilization process was changed to 70° C.

Example 12

Experiment was made under the same conditions as in Example 10 except that the temperature in the stabilization process was changed to 70° C.

Example 13

Experiment was made under the same conditions as in Example 12 except that when the precursor was grown, the velocity of the air blow after the Co middle addition was decreased to 34.6 mL/min.

Example 14

Experiment was made under the same conditions as in Example 13 except that in the precursor forming process, the liquid temperature after the crystal nuclei of the iron oxyhydroxide were generated was 50° C., and the velocity of the air blown into the liquid until the 40% of the total $Fe^{2+}$ present in the reaction original solution was oxidized was 106 mL/min.

Example 15

Experiment was made under the same conditions as in Example 14 except that the charging Co/Fe molar ratio in the initial phase was 0.08 and the charging Co/Fe molar ratio in the middle addition was 0.27.

Example 16

Experiment was made under the same conditions as in Example 13 except that the charging Co/Fe molar ratio in the initial phase was 0.08, the charging Co/Fe molar ratio in the middle addition was 0.27, and in the precursor forming process, the liquid temperature in the air blow after the Co middle addition and before the oxidation was completed was changed from 60° C. to 55° C.

Comparative Examples 1 to 5

In Comparative Examples 1, 2, 3, 4 and 5, experiments were made under the same conditions as in Example 1 except that the charging Co/Fe molar ratios in the initial phase were respectively 0.05, 0.10, 0.15, 0.20 and 0.25, and the Co middle addition was not performed.

TABLE 1

| | Co Charging content | | | | | | Analyzed composition | | |
|---|---|---|---|---|---|---|---|---|---|
| | Initial phase | Middle addition | Total | Mean | Mean | | | | |
| Example No. | Co/Fe molar ratio | Co/Fe molar ratio | Co/Fe molar ratio | major axis (nm) | minor axis (nm) | Mean axial ratio | Co/Fe molar ratio | Al/(Fe + Co) molar ratio | Y/(Fe + Co) molar ratio |
| Comp. Ex. 1 | 0.05 | 0 | 0.05 | 39.9 | 24.6 | 1.62 | 0.049 | 0.055 | 0.029 |
| Comp. Ex. 2 | 0.10 | 0 | 0.10 | 33.7 | 22.4 | 1.50 | 0.097 | 0.056 | 0.027 |
| Comp. Ex. 3 | 0.15 | 0 | 0.15 | 33.7 | 20.3 | 1.66 | 0.142 | 0.054 | 0.026 |
| Comp. Ex. 4 | 0.20 | 0 | 0.20 | 33.7 | 18.9 | 1.78 | 0.184 | 0.055 | 0.025 |
| Comp. Ex. 5 | 0.25 | 0 | 0.25 | 33.9 | 17.8 | 1.90 | 0.236 | 0.055 | 0.024 |
| Ex. 1 | 0.10 | 0.10 | 0.20 | 34.6 | 22.1 | 1.57 | 0.187 | 0.055 | 0.025 |
| Ex. 2 | 0.10 | 0.15 | 0.25 | 37.3 | 24.0 | 1.55 | 0.231 | 0.053 | 0.024 |
| Ex. 3 | 0.10 | 0.20 | 0.30 | 37.1 | 24.1 | 1.54 | 0.284 | 0.054 | 0.023 |

TABLE 1-continued

| Example No. | Co Charging content: Initial phase Co/Fe molar ratio | Co Charging content: Middle addition Co/Fe molar ratio | Co Charging content: Total Co/Fe molar ratio | Mean major axis (nm) | Mean minor axis (nm) | Mean axial ratio | Analyzed composition: Co/Fe molar ratio | Analyzed composition: Al/(Fe + Co) molar ratio | Analyzed composition: Y/(Fe + Co) molar ratio |
|---|---|---|---|---|---|---|---|---|---|
| Ex. 4 | 0.10 | 0.15 | 0.25 | 36.3 | 23.2 | 1.56 | 0.235 | 0.055 | 0.025 |
| Ex. 5 | 0.10 | 0.20 | 0.30 | 37.8 | 23.7 | 1.59 | 0.285 | 0.055 | 0.023 |
| Ex. 6 | 0.10 | 0.25 | 0.35 | 36.3 | 22.9 | 1.59 | 0.336 | 0.055 | 0.023 |
| Ex. 7 | 0.15 | 0.15 | 0.30 | 35.3 | 21.7 | 1.63 | 0.279 | 0.055 | 0.024 |
| Ex. 8 | 0.10 | 0.15 | 0.25 | 38.8 | 24.9 | 1.56 | 0.239 | 0.055 | 0.025 |
| Ex. 9 | 0.10 | 0.20 | 0.30 | 37.8 | 24.6 | 1.54 | 0.284 | 0.055 | 0.023 |
| Ex. 10 | 0.10 | 0.25 | 0.35 | 37.1 | 23.7 | 1.57 | 0.331 | 0.055 | 0.023 |
| Ex. 11 | 0.10 | 0.20 | 0.30 | 35.9 | 23.7 | 1.51 | 0.284 | 0.055 | 0.023 |
| Ex. 12 | 0.10 | 0.25 | 0.35 | 39.1 | 25.0 | 1.56 | 0.338 | 0.055 | 0.023 |
| Ex. 13 | 0.10 | 0.25 | 0.35 | 43.1 | 28.8 | 1.50 | 0.332 | 0.053 | 0.021 |
| Ex. 14 | 0.10 | 0.25 | 0.35 | 40.6 | 26.0 | 1.56 | 0.325 | 0.053 | 0.021 |
| Ex. 15 | 0.08 | 0.27 | 0.35 | 41.7 | 27.7 | 1.51 | 0.337 | 0.054 | 0.022 |
| Ex. 16 | 0.08 | 0.27 | 0.35 | 43.6 | 28.1 | 1.55 | 0.333 | 0.054 | 0.021 |

TABLE 2

| Example No. | Volume resistivity (Ω · cm): 4 kN 13 MPa | 8 kN 25 MPa | 12 kN 38 MPa | 16 kN 51 MPa | 20 kN 64 MPa | Powder characteristics: BET ($m^2/g$) | TAP ($g/cm^3$) |
|---|---|---|---|---|---|---|---|
| Comp. Ex. 1 | $9 \times 10^8$ | $3 \times 10^7$ | $3 \times 10^6$ | $6 \times 10^5$ | UR | 39.6 | 0.89 |
| Comp. Ex. 2 | $1 \times 10^9$ | $4 \times 10^8$ | $8 \times 10^7$ | $2 \times 10^7$ | $6 \times 10^6$ | 43.4 | 0.99 |
| Comp. Ex. 3 | $2 \times 10^9$ | $9 \times 10^8$ | $4 \times 10^8$ | $1 \times 10^8$ | $3 \times 10^7$ | 45.7 | 0.95 |
| Comp. Ex. 4 | $5 \times 10^8$ | $3 \times 10^8$ | $2 \times 10^8$ | $1 \times 10^8$ | $4 \times 10^7$ | 47.3 | 0.89 |
| Cornp. Ex. 5 | $5 \times 10^9$ | $1 \times 10^9$ | $3 \times 10^8$ | $6 \times 10^7$ | $2 \times 10^7$ | 47.8 | 0.97 |
| Ex. 1 | $1 \times 10^{10}$ | $3 \times 10^9$ | $5 \times 10^8$ | $1 \times 10^8$ | $3 \times 10^7$ | 43.9 | 1.02 |
| Ex. 2 | $9 \times 10^9$ | $3 \times 10^9$ | $7 \times 10^8$ | $2 \times 10^8$ | $6 \times 10^7$ | 44.3 | 1.00 |
| Ex. 3 | $8 \times 10^9$ | $5 \times 10^9$ | $2 \times 10^9$ | $1 \times 10^9$ | $4 \times 10^8$ | 45.5 | 1.06 |
| Ex. 4 | $2 \times 10^{10}$ | $6 \times 10^9$ | $1 \times 10^9$ | $3 \times 10^8$ | $9 \times 10^7$ | 42.9 | 0.99 |

TABLE 2-continued

| Example No. | Volume resistivity (Ω · cm): 4 kN 13 MPa | 8 kN 25 MPa | 12 kN 38 MPa | 16 kN 51 MPa | 20 kN 64 MPa | Powder characteristics: BET ($m^2/g$) | TAP ($g/cm^3$) |
|---|---|---|---|---|---|---|---|
| Ex. 5 | $6 \times 10^9$ | $3 \times 10^9$ | $2 \times 10^9$ | $7 \times 10^8$ | $2 \times 10^8$ | 42.9 | 1.03 |
| Ex. 6 | $3 \times 10^{10}$ | $1 \times 10^{10}$ | $4 \times 10^9$ | $1 \times 10^9$ | $4 \times 10^8$ | 42.9 | 1.01 |
| Ex. 7 | $1 \times 10^{10}$ | $4 \times 10^9$ | $1 \times 10^9$ | $2 \times 10^8$ | $7 \times 10^7$ | 44.1 | 1.04 |
| Ex. 8 | $8 \times 10^{10}$ | $6 \times 10^9$ | $8 \times 10^8$ | $2 \times 10^8$ | $4 \times 10^7$ | 40.6 | 1.00 |
| Ex. 9 | $2 \times 10^{11}$ | $1 \times 10^{10}$ | $2 \times 10^9$ | $4 \times 10^8$ | $1 \times 10^8$ | 40.1 | 1.14 |
| Ex. 10 | $1 \times 10^{11}$ | $1 \times 10^{10}$ | $2 \times 10^9$ | $4 \times 10^8$ | $1 \times 10^8$ | 40.6 | 1.13 |
| Ex. 11 | $8 \times 10^{10}$ | $8 \times 10^9$ | $1 \times 10^9$ | $3 \times 10^8$ | $7 \times 10^7$ | 38.8 | 1.12 |
| Ex. 12 | $4 \times 10^{10}$ | $2 \times 10^9$ | $3 \times 10^8$ | $5 \times 10^7$ | $1 \times 10^7$ | 40.8 | 1.09 |
| Ex. 13 | $8 \times 10^9$ | $3 \times 10^9$ | $6 \times 10^8$ | $1 \times 10^8$ | $4 \times 10^7$ | 36.9 | 1.14 |
| Ex. 14 | $7 \times 10^8$ | $4 \times 10^8$ | $2 \times 10^8$ | $6 \times 10^7$ | $2 \times 10^7$ | 37.8 | 1.12 |
| Ex. 15 | $1 \times 10^9$ | $7 \times 10^8$ | $4 \times 10^8$ | $1 \times 10^8$ | $5 \times 10^7$ | 38.1 | 1.12 |
| Ex. 16 | $4 \times 10^8$ | $3 \times 10^8$ | $2 \times 10^8$ | $1 \times 10^8$ | $6 \times 10^7$ | 37.1 | 1.17 |

UR: Under Range

TABLE 3

| Example No. | Magnetic characteristics: Hc (Oe) | Hc (kA/m) | σs ($Am^2/kg$) <a> | SQ | SFD | Δσs (%) | Formula 1 right side 50[Co/Fe] + 151 <b> | σs − formula (1) right side <a> − <b> |
|---|---|---|---|---|---|---|---|---|
| Comp. Ex. 1 | 816 | 64.9 | 152.2 | 0.355 | 2.929 | 12.0 | 153.4 | −1.2 |
| Comp. Ex. 2 | 784 | 62.4 | 153.9 | 0.366 | 2.922 | 13.6 | 155.8 | −1.9 |
| Comp. Ex. 3 | 880 | 70.0 | 156.2 | 0.385 | 2.791 | 13.6 | 158.1 | −1.9 |
| Comp. Ex. 4 | 962 | 76.6 | 157.6 | 0.398 | 2.708 | 12.4 | 160.2 | −2.6 |
| Comp. Ex. 5 | 991 | 78.9 | 160.9 | 0.407 | 2.657 | 11.8 | 162.8 | −1.9 |
| Ex. 1 | 823 | 65.5 | 162.8 | 0.371 | 2.906 | 11.1 | 160.3 | 2.5 |
| Ex. 2 | 779 | 62.0 | 165.5 | 0.363 | 3.001 | 9.7 | 162.6 | 2.9 |
| Ex. 3 | 757 | 60.2 | 167.4 | 0.354 | 3.100 | 8.9 | 165.2 | 2.2 |
| Ex. 4 | 821 | 65.3 | 165.5 | 0.372 | 2.907 | 8.8 | 162.8 | 2.7 |
| Ex. 5 | 795 | 63.3 | 167.6 | 0.365 | 2.971 | 8.5 | 165.2 | 2.4 |
| Ex. 6 | 779 | 62.0 | 169.4 | 0.360 | 3.038 | 7.7 | 167.8 | 1.6 |
| Ex. 7 | 857 | 68.2 | 167.9 | 0.375 | 2.919 | 10.5 | 164.9 | 3.0 |
| Ex. 8 | 825 | 65.7 | 172.4 | 0.366 | 2.946 | 10.0 | 163.0 | 9.4 |
| Ex. 9 | 799 | 63.6 | 174.9 | 0.360 | 3.007 | 8.9 | 165.2 | 9.7 |
| Ex. 10 | 783 | 62.3 | 176.4 | 0.355 | 3.076 | 9.5 | 167.6 | 8.8 |

TABLE 3-continued

| Example | Magnetic characteristics | | | | | | Formula 1 right side | σs − |
|---|---|---|---|---|---|---|---|---|
| | Hc | | σs (Am²/kg) | | | | 50[Co/Fe] + 151 | formula (1) right side |
| No. | (Oe) | (kA/m) | <a> | SQ | SFD | Δσs (%) | <b> | <a> − <b> |
| Ex. 11 | 795 | 63.3 | 178.5 | 0.358 | 3.019 | 11.6 | 165.2 | 13.3 |
| Ex. 12 | 780 | 62.1 | 179.7 | 0.355 | 3.063 | 11.5 | 167.9 | 11.9 |
| Ex. 13 | 756 | 60.2 | 181.1 | 0.341 | 3.161 | 9.5 | 167.6 | 13.5 |
| Ex. 14 | 789 | 62.8 | 178.4 | 0.353 | 3.085 | 9.3 | 167.3 | 11.2 |
| Ex. 15 | 734 | 58.4 | 180.6 | 0.339 | 3.211 | 9.3 | 167.9 | 12.8 |
| Ex. 16 | 707 | 56.3 | 178.5 | 0.326 | 3.288 | 9.5 | 167.7 | 10.9 |

TABLE 4

| Example | Relative permeability | | | | | | | | | Relative permeability | | | | | | | | |
|---|---|---|---|---|---|---|---|---|---|---|---|---|---|---|---|---|---|---|
| | 1 GHz | | | 2 GHz | | | 3 GHz | | | 1 GHz | | | 2 GHz | | | 3 GHz | | |
| No. | μ' | μ'' | tan δ (μ) | μ' | μ'' | tan δ (μ) | μ' | μ'' | tan δ (μ) | ε' | ε'' | tan δ (ε) | ε' | ε'' | tan δ (ε) | ε' | ε'' | tan δ (ε) |
| Comp. Ex. 1 | 2.29 | 0.031 | 0.014 | 2.40 | 0.081 | 0.034 | 2.54 | 0.210 | 0.083 | 17.46 | 0.837 | 0.048 | 17.18 | 0.844 | 0.049 | 17.15 | 0.901 | 0.053 |
| Comp. Ex. 2 | 2.67 | 0.041 | 0.015 | 2.82 | 0.095 | 0.034 | 3.02 | 0.270 | 0.089 | 13.67 | 0.438 | 0.032 | 13.50 | 0.476 | 0.035 | 13.37 | 0.535 | 0.040 |
| Comp. Ex. 3 | 2.59 | 0.033 | 0.013 | 2.71 | 0.070 | 0.026 | 2.89 | 0.192 | 0.066 | 14.12 | 0.447 | 0.032 | 13.95 | 0.495 | 0.035 | 13.85 | 0.564 | 0.041 |
| Comp. Ex. 4 | 2.56 | 0.020 | 0.008 | 2.67 | 0.050 | 0.019 | 2.85 | 0.153 | 0.054 | 13.13 | 0.368 | 0.028 | 12.98 | 0.420 | 0.032 | 12.88 | 0.484 | 0.038 |
| Camp. Ex. 5 | 2.55 | 0.031 | 0.012 | 2.65 | 0.059 | 0.022 | 2.81 | 0.157 | 0.056 | 14.37 | 0.562 | 0.039 | 14.15 | 0.611 | 0.043 | 14.02 | 0.673 | 0.048 |
| Ex. 1 | 2.75 | 0.029 | 0.011 | 2.90 | 0.081 | 0.028 | 3.11 | 0.261 | 0.084 | 13.04 | 0.449 | 0.034 | 12.90 | 0.500 | 0.039 | 12.88 | 0.588 | 0.046 |
| Ex. 2 | 2.98 | 0.040 | 0.013 | 3.17 | 0.133 | 0.042 | 3.41 | 0.422 | 0.124 | 13.36 | 0.560 | 0.042 | 13.15 | 0.610 | 0.046 | 13.07 | 0.682 | 0.052 |
| Ex. 3 | 3.26 | 0.055 | 0.017 | 3.48 | 0.187 | 0.054 | 3.75 | 0.588 | 0.157 | 13.35 | 0.558 | 0.042 | 13.13 | 0.613 | 0.047 | 13.00 | 0.679 | 0.052 |
| Ex. 4 | 3.03 | 0.040 | 0.013 | 3.22 | 0.129 | 0.040 | 3.48 | 0.409 | 0.118 | 13.37 | 0.491 | 0.037 | 13.16 | 0.550 | 0.042 | 13.00 | 0.611 | 0.047 |
| Ex. 5 | 3.19 | 0.041 | 0.013 | 3.40 | 0.148 | 0.044 | 3.68 | 0.488 | 0.133 | 13.61 | 0.544 | 0.040 | 13.39 | 0.602 | 0.045 | 13.25 | 0.667 | 0.050 |
| Ex. 6 | 3.26 | 0.050 | 0.015 | 3.48 | 0.177 | 0.051 | 3.75 | 0.561 | 0.150 | 13.12 | 0.513 | 0.039 | 12.91 | 0.572 | 0.044 | 12.78 | 0.639 | 0.050 |
| Ex. 7 | 3.04 | 0.037 | 0.012 | 3.21 | 0.109 | 0.034 | 3.49 | 0.367 | 0.105 | 13.92 | 0.479 | 0.034 | 13.75 | 0.552 | 0.040 | 13.62 | 0.636 | 0.047 |
| Ex. 8 | 3.07 | 0.040 | 0.013 | 3.26 | 0.141 | 0.043 | 3.51 | 0.439 | 0.125 | 13.46 | 0.548 | 0.041 | 13.27 | 0.590 | 0.044 | 13.17 | 0.664 | 0.050 |
| Ex. 9 | 3.22 | 0.040 | 0.012 | 3.44 | 0.166 | 0.048 | 3.71 | 0.532 | 0.143 | 12.93 | 0.510 | 0.039 | 12.72 | 0.547 | 0.043 | 12.58 | 0.603 | 0.048 |
| Ex. 10 | 3.34 | 0.046 | 0.014 | 3.58 | 0.199 | 0.056 | 3.85 | 0.636 | 0.165 | 12.96 | 0.518 | 0.040 | 12.75 | 0.554 | 0.043 | 12.61 | 0.612 | 0.049 |
| Ex. 11 | 3.25 | 0.029 | 0.009 | 3.48 | 0.158 | 0.045 | 3.74 | 0.531 | 0.142 | 13.44 | 0.531 | 0.040 | 13.27 | 0.576 | 0.043 | 13.19 | 0.650 | 0.049 |
| Ex. 12 | 3.38 | 0.044 | 0.013 | 3.63 | 0.199 | 0.055 | 3.89 | 0.646 | 0.166 | 12.87 | 0.493 | 0.038 | 12.68 | 0.531 | 0.042 | 12.56 | 0.588 | 0.047 |
| Ex. 13 | 3.63 | 0.079 | 0.022 | 3.89 | 0.352 | 0.090 | 4.03 | 0.877 | 0.218 | 13.96 | 0.600 | 0.043 | 13.76 | 0.631 | 0.046 | 13.66 | 0.703 | 0.051 |
| Ex. 14 | 3.62 | 0.057 | 0.016 | 3.90 | 0.268 | 0.069 | 4.14 | 0.791 | 0.191 | 14.27 | 0.634 | 0.044 | 14.02 | 0.722 | 0.051 | 13.81 | 0.806 | 0.058 |
| Ex. 15 | 3.71 | 0.074 | 0.020 | 4.01 | 0.339 | 0.085 | 4.19 | 0.919 | 0.219 | 13.52 | 0.482 | 0.036 | 13.34 | 0.560 | 0.042 | 13.20 | 0.647 | 0.049 |
| Ex. 16 | 3.83 | 0.092 | 0.024 | 4.10 | 0.464 | 0.113 | 4.17 | 1.050 | 0.252 | 14.22 | 0.615 | 0.043 | 13.97 | 0.701 | 0.050 | 13.77 | 0.787 | 0.057 |

FIG. 1 shows a relationship between the total Co/Fe molar ratio (analysis values) and the saturation magnetization σs in the examples. It can be seen that, in Examples in which the Co middle addition was performed in the course of growing of the precursor, effect of increasing σs with increase of the Co content is greater as compared to that in Comparative Examples in which the Co middle addition was not performed. In FIG. 1, the border line of the foregoing formula (1) was shown. When the precursor was grown by the technique of the Co middle addition, such a significant effect of increasing σs that the formula (1) is satisfied can be achieved. Incidentally, among the plots of the Examples, the white square plots represent Examples 8 to 10 in which two sets total of the reduction process and the stabilization process were repeatedly performed, the white triangle plots represent Examples 11 to 13 in which two sets total of the reduction process and the stabilization process were repeatedly performed at the temperature of the stabilization process of 70° C., and the white inverted triangle plots represent Examples 14 to 16 (the same is applied also in FIG. 2 mentioned below). In the Examples, more significant effect of increasing σs can be achieved.

FIG. 2 shows a relationship between the entire Co/Fe molar ratio (analysis values) and the coercive force Hc of the examples. It can be seen that, in Examples in which the Co middle addition was performed in the course of growing of the precursor, increase of the coercive force Hc was suppressed more as compared to Comparative Examples in which the Co middle addition was not performed.

As for the magnetic permeability, the real part μ' of the complex relative permeability at 1 to 3 GHz is significantly increased in Examples than in Comparative Examples. This is considered to be an effect of the higher σs and the suppressed Hc increase in the Fe—Co alloy powders of Examples. In addition, in Examples, the loss tangent tan δ (μ) was kept low in spite of the increased μ'. This is considered to be an effect of the fact that the mean axial ratio of the Fe—Co alloy powder was controlled in an adequate range without becoming too small by the Co middle addition.

The invention claimed is:

1. A Fe—Co alloy powder having a mean particle size of 49 nm or less, wherein a coercive force Hc is 52.0 to 78.0 kA/m, a saturation magnetization σs is 160 Am²/kg or higher, a mean axial ratio of the particles constituting the powder is more than 1.40 and less than 1.70, and a mean minor axis is from 22.1 nm to 28.8 nm, wherein the mean axial ratio equals a mean major axis/mean minor axis, wherein the Fe—Co alloy powder contains Al and one or more rare earth elements, wherein at least Y as a rare earth element is present.

2. The Fe—Co alloy powder according to claim 1, wherein the saturation magnetization as ($Am^2/kg$) satisfies the following formula (1) in a relationship with a Co/Fe molar ratio:

$$\sigma s \geq 50[Co/Fe]+151 \quad (1)$$

wherein [Co/Fe] is the molar ratio of Co and Fe in the chemical composition of the powder.

3. The Fe—Co alloy powder according to claim 1, wherein the Co/Fe molar ratio is 0.15 to 0.50.

4. The Fe—Co alloy powder according to claim 1, wherein according to a double ring electrode method in accordance with JIS K6911, when 1.0 g of the metal powder is interposed between electrodes and a measurement is performed at an applied voltage of 10 V while exerting a vertical load of 25 MPa (8 kN), the volume resistivity is $1.0\times10^8$ Ω·cm or more.

5. The Fe—Co alloy powder according to claim 1, wherein the powder has such a property that, when the powder is mixed with an epoxy resin in a mass ratio of 90:10 to produce a molded body and the molded body is subjected to a magnetic measurement, the real part μ' of the complex relative permeability is 2.50 or more and the loss tangent tan δ(μ) of the complex relative permeability is less than 0.05, at 1 GHz.

6. The Fe—Co alloy powder according to claim 1, wherein the powder has such a property that, when the powder is mixed with an epoxy resin in a mass ratio of 90:10 to produce a molded body and the molded body is subjected to a magnetic measurement, the real part μ' of the complex relative permeability is 2.80 or more and the loss tangent tan δ(μ) of the complex relative permeability is less than 0.12, at 2 GHz.

7. The Fe—Co alloy powder according to claim 1, wherein the powder has such a property that, when the powder is mixed with an epoxy resin in a mass ratio of 90:10 to produce a molded body and the molded body is subjected to a magnetic measurement, the real part μ' of the complex relative permeability is 3.00 or more and the loss tangent tan δ(μ) of the complex relative permeability is less than 0.30, at 3 GHz.

8. An antenna formed by using the Fe—Co alloy powder according to any claim 1.

9. An antenna for receiving, transmitting, or receiving and transmitting a radio wave having a frequency of 430 MHz or higher, which comprises as a constitution member a molded body in which the Fe—Co alloy powder according to claim 1 is mixed with a resin composition.

10. An inductor formed by using the Fe—Co alloy powder according to claim 1.

11. An EMI filter formed by using the Fe—Co alloy powder according to claim 1.

* * * * *